United States Patent [19]

van Stratum et al.

[11] 4,007,393

[45] Feb. 8, 1977

[54] BARIUM-ALUMINUM-SCANDATE DISPENSER CATHODE

[75] Inventors: Antonius Johannes Alberta van Stratum; Johannes Gerardus van Os; Johannes Reinier Blatter; Pieter Zalm, all of Eindhoven, Netherlands

[73] Assignee: U.S. Philips Corporation, New York, N.Y.

[22] Filed: Dec. 2, 1975

[21] Appl. No.: 636,931

[30] Foreign Application Priority Data

Feb. 21, 1975 Netherlands ..... 7502052

[52] U.S. Cl. ..... 313/346 R; 313/337; 252/521

[51] Int. Cl.[2] ..... H01J 1/14; H01J 19/06

[58] Field of Search ..... 313/337, 346, 346 DC; 252/521

[56] References Cited

UNITED STATES PATENTS

| | | | |
|---|---|---|---|
| 3,076,916 | 2/1963 | Koppius | 313/346 R |
| 3,358,178 | 12/1967 | Figner et al. | 313/346 R |
| 3,497,757 | 2/1970 | Zalm et al. | 313/346 R |
| 3,530,327 | 9/1970 | Zollweg et al. | 303/346 R X |
| 3,558,966 | 1/1971 | Hill et al. | 313/346 R |
| 3,719,856 | 3/1973 | Koppius | 313/346 R |
| 3,766,423 | 10/1973 | Menelly | 313/346 R |

*Primary Examiner*—Saxfield Chatmon, Jr.
*Attorney, Agent, or Firm*—Frank R. Trifari; Jack Oisher

[57] ABSTRACT

A dispenser cathode comprising a porous metal body which has an emissive surface and the pores of which contain one or more compounds for dispensing at least barium and scandium to the emissive surface, which compounds are composed of at least barium oxide, scandium oxide and aluminium oxide, in which the quantity of scandium oxide is less than 10% by weight, and preferably 3% by weight, of the overall quantity of the dispensing compound (s), has substantially the same good emissive properties as cathodes in which the dispensing compound comprises 5.5% by weight of scandium oxide and 18% by weight of yttrium oxide ($Y_2O_3$), or barium scandate as a dispensing compound.

8 Claims, 2 Drawing Figures

| I | II | III |
|---|---|---|
| Wo | Wo | Wo |
| BaO 62,5% | BaO 74 % | BaO 65 % |
| $Sc_2O_3$ 37,5% | CaO 2,5% | CaO 17,5% |
| | $Sc_2O_3$ 5,5% | $Al_2O_3$ 14,5% |
| | $Y_2O_3$ 18 % | $Sc_2O_3$ 3 % |
| 1,5 - 4 A/cm$^2$ | 5 A/cm$^2$ | 5 A/cm$^2$ |
| 1100°C | 1000° C | 1000°C |
| 2000 3000 h | 2000 h | 3000 h |

BARIUM-ALUMINUM-SCANDATE DISPENSER CATHODE

The invention relates to a dispenser cathode comprising a porous metal body which has an emissive surface and the pores of which contain one or more compounds for dispensing at least barium and scandium to the emissive surface, which compound or compounds comprise at least barium-oxide (BaO) and scandium-oxide ($ScO_3$).

A scandium-containing dispenser cathode is known from U.S. Pat. No. 3,358,178 which describes how a mixture of powdered tungsten and barium-scandate ($Ba_3Sc_4O_9$) is compressed to form a body having an emissive surface. Approximately 5 – 30% by wieght of said body consists of barium-scandate which in turn is formed from 62.5% by weight of barium-oxide (BaO) and 37.5% by weight of scandium-oxide ($Sc_2O_3$). Owing to the high melting-point of barium-scandate, impregnation is impossible and it is also impossilbe to manufacture the emissive body other than by compressing a mixture of metal powder and bariumscandate. As a result, it is very difficult to manufacture large cathodes, so that the field of application of such a cathode is restricted. In addition, scandium is very expensive and hence less attractive for use in large quantities and on a large scale.

A dispenser cathode of the kind mentioned in the first paragraph is known from U.S. Pat. No. 3,719,856 in which are described inter alia impregnated cathodes in which the dispensing compound or compounds comprise a mixture of barium-oxide (BaO), calcium-oxide (CaO), scandium oxide ($Sc_2O_3$) and yttrium oxide ($Y_2O_3$). The quantities of scandium oxide and yttrium oxide in the dispensing compound(s) are 5.5% and 18% by weight, respectively. Owing to the use of these comparatively large quantities of rare-earth metal oxides, scandium oxide and the likewise expensive yttrium oxide, this type of cathode is very expensive.

It is the object of the invention to provide a cathode which comprises only a very small quantity of scandium oxide and no yttrium oxide but which does have the same good emissive properties as the above-mentioned cathodes, and which can be manufactured by impregnation. As a result of this, the cathode is cheap and can have unrestricted dimensions (unrestricted by the limitations of powder technology).

According to the invention, a cathode of the kind mentioned in the first paragraph is characterized in that the dispensing compound or compounds also comprise aluminum oxide and in that the quantity of scandium oxide is less than 10% by weight of the overall quantity of the dispensing compound(s).

It has been found that such cathodes have substantially the same favourable emissive properties as dispenser cathodes with only barium scandate as the dispensing compound, or the cathodes known from U.S. Pat. No. 3,719,856. A great advantage is that cathodes embodying the invention, in contrast with the barium scandate containing cathodes, can be manufactured by impregnation with dispensing compound(s), while in addition the quantity of expensive scandium-oxide required is considerably smaller and is preferably 3% by wieght of the dispensing compound(s). In addition, it has been found that such cathodes rapidly regain their emissive properties after ion bombardment (poisoning) of the emissive surface, in contrast with the known cathodes: the reactivation time is less than 10 minutes. Such cathodes can be manufactured in any desired dimension and can be used for a large number of different applications.

Very good results are obtained if the quantity of scandium-oxide is 2 – 7% by weight of the overall quantity of the dispensing compound(s). The result is optimum with 3% by weight of scandium-oxide.

When the dispensing compounds are formed from scandium-oxide with barium-oxide, calcium oxide and aluminum oxide added in a weight ratio of 5 : 3 : 2 or 4 : 1 : 1, these dispensing compounds will consist mainly of barium scandate aluminate and calcium scandate aluminate.

The invention is based on the recognition of the fact that the presence of a very thin layer of scandium oxide on the emissive surface is essential for the operation of the cathode. This follows from the following experiment. A known cathode manufactured by impregnation with barium calcium aluminate with the gross composition 5 $BaO.2Al_2O_3.3$ CaO is covered with scandium oxide ($Sc_2O_3$) by wetting it with a dilute solution of scandium nitrate in water or by providing the emissive surface with a layer of scandium oxide ($Sc_2O_3$) by sputtering. The emissive properties of such a cathode approach those of the cathode consisting of tungsten and barium scandate mentioned in the above-mentioned U.S. Pat. No. 3,358,178. The life of such a cathode is, of course, short since no dispensing takes place. Removing the thin layer of scandium oxide, for example by polishing or sputtering in argon, results in the known lower emission.

The invention will now be described in greater detail with reference to an embodiment and the drawing, in which.

Figures 1, 2:
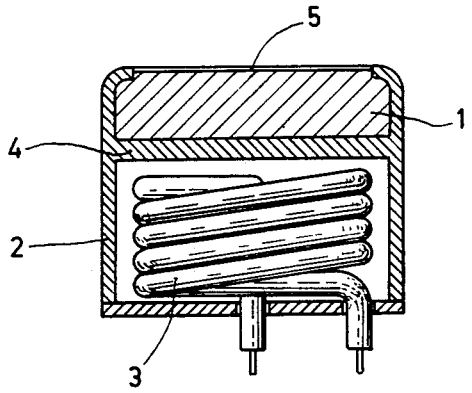
FIG. 1 shows a cathode according to the invention.
FIG. 2 is a table in which a cathode according to the invention is compared with prior-art cathodes.

Referring to FIG. 1, the porous metal body 1 is surrounded by a metal cylinder 2, preferably of molybdenum. Said cylinder contains a heating member 3 and a partition 4, the latter likewise preferably of molybdenum, to prevent emission from the emissive body 1 to the heating member 3. 5 denotes the emissive surface of the cathode.

The porous metal body 1, which is manufactured from tungsten, has a density of approximately 80% (usually between 78% and 85% of the bulk material). Said porous metal body is impregnated in the usual manner with a mixture containing 3% by weight of scandium oxide, the remainder being barium oxide, calcium oxide and aluminum oxide. Said mixture has previously been ground for a long time and then sieved so that the diameters of the particles are mainly between 5 and 50 $\mu$m.

The mixture can also be obtained by adding the following mixture to 800 ml of water:

17: g of Al $(NO_3)_3$
26.1: g of $Ba(NO_3)_2$
9.8: g of $Ca(NO_3)_2$
1.6: g of $Sc_2O_3$ in 5 ml $HNO_3$.

This solution of nitrates is added to 50 g of ammonium carbonate in 200 ml water. This should be carried out dropwise and with continuous stirring. The solid which forms the desired mixture is obtained by centrifuging, separating and washing three times with water, followed by drying in air at 20° C. The cathode is formed by impregnating the porous metal body with the molten mixture. For this purpose, the porous metal body should be intensively contacted with the molten mixture so that this flows into the pores and diffuses and fills them substantially entirely. Excess mixture is then removed from the impregnated cathode by means of a tungsten brush, and the cathode is rinsed and vibrated ultrasonically in freon. The cathode is then mounted in an evacuated envelope and activated at approximately 1500° K.

Column I in FIG. 2 shows the composition in per cent by weight, the admissible current density of the cathode in A/cm² at a certain temperature in °C and the minimum life in hours of the dispensing cathode known from U.S. Pat. No 3,358,178. Column II indicates the composition in per cent by weight and properties of the cathode known from U.S. Pat. No. 3,719,856, and column III indicates the composition in per cent by weight and the properties of a cathode according to the present invention. It can be seen from this table that a considerably smaller quantity of rare-earth metal oxide is necessary in the cathode according to the invention to obtain a long life of 3000 hours and good emissive properties (5 A/cm² at 1000° C). In addition, a cathode with a composition according to the invention has a faster reactivation capacity (less than 10 minutes) after ion bombardment (poisoning of the cathode) than the known cathodes.

What is claimed is:

1. A dispenser cathode comprising a porous metal body which has an emissive surface and the pores of which contain compounds for dispensing when heated at least barium and scandium to the emissive surface, said compounds comprising at least barium oxide, scandium oxide and aluminum oxide wherein the total quantity of rare earth oxides present including scandium oxide being less than 10% by weight of the overall quantity of the dispensing compounds.

2. A dispenser cathode as claimed in claim 1, wherein the quantity of scandium oxide present is from 2% to 7% by weight of the the overall quantity of the dispensing compounds.

3. A dispenser cathode as claimed in claim 2, wherein the quantity of scandium oxide present is approximately 3% by weight of the overall quantity of the dispensing compounds.

4. A dispenser cathode as claimed in claim 1, wherein the dispensing compounds also comprise calcium oxide, the ratio between the barium oxide, calcium oxide and aluminum oxide being in the range of 5 : 3 : 2 to 4 : 1 : 1.

5. A dispenser cathode as claimed in claim 1, wherein the metal body comprises tungsten, and the dispensing compounds are a fused mixture.

6. A dispenser cathode as claimed in claim 5, wherein the dispensing compounds are provided in the pores by impregnation from a melt.

7. A dispenser cathode as claimed in claim 1, wherein the dispensing compounds are free of yttrium oxide.

8. An electric discharge tube having a dispenser cathode as claimed in claim 1.

* * * * *